US005447109A

United States Patent [19]

Karaba et al.

[11] Patent Number: 5,447,109

[45] Date of Patent: Sep. 5, 1995

[54] THREAD HANDLING SYSTEM FOR A SEWING MACHINE

[75] Inventors: James M. Karaba, Rockford; Larry D. Crisler, Crystal Lake, both of Ill.

[73] Assignee: Union Special Corporation, Huntley, Ill.

[21] Appl. No.: 143,821

[22] Filed: Oct. 27, 1993

[51] Int. Cl.[6] ..... B65H 57/00

[52] U.S. Cl. ..... 112/302; 112/245

[58] Field of Search ..... 112/302, 241, 242, 243, 112/244, 245, 246, 284, 220, 221; 74/44

[56] References Cited

U.S. PATENT DOCUMENTS

| | | | |
|---|---|---|---|
| 1,166,834 | 1/1916 | Hemleb | 112/245 |
| 2,998,787 | 9/1961 | Pollmeier | 112/200 |
| 3,368,508 | 2/1968 | Angele | 112/245 |
| 3,654,883 | 4/1972 | Reimer et al. | 112/245 |
| 4,457,247 | 7/1984 | von Hagen et al. | 112/302 |
| 4,582,008 | 4/1986 | Marsh et al. | 112/221 X |
| 4,671,195 | 6/1987 | Wolff et al. | 112/199 |
| 4,867,083 | 9/1989 | Fietta et al. | 112/221 X |
| 5,007,355 | 4/1991 | Yanagisawa | 112/221 X |

FOREIGN PATENT DOCUMENTS

| | | | |
|---|---|---|---|
| 163062 | 5/1964 | U.S.S.R. | 112/245 |

OTHER PUBLICATIONS

Union Special Catalog No. 282, Instructions and illustrated parts list, Third Edition, Published Sep. 1991, pp. 46–47.

Union Special Catalog No. 131M Second Edition, Instructions for Adjusting and Operating, List of Parts Dec. 1967, pp. 5 and 20.

Union Special Catalog No. 133M Fourth Edition, Adjusting Instructions and Illustrated parts list for Class 57800 Advanced Series, Differential Feed Coverseaming Machines, Nov. 14 1981, pp. 6 and 22.

Union Special Catalog No. 303A, Adjusting Instructions and Illustrated parts list, Aug. 1988, p. 38.

*Primary Examiner*—Andrew M. Falik
*Assistant Examiner*—Paul C. Lewis
*Attorney, Agent, or Firm*—Willian Brinks Hofer Gilson & Lione

[57] ABSTRACT

A new thread control mechanism including a second movable needle thread control secured to the upper end of the needle bar from which the thread extends to the needles, a first movable needle thread control eyelet operatively connected to the needle bar such that it reciprocates vertically in synchrony with the first movable needle thread control, and stationary needle thread eyelets adjustably mounted on the exterior of the sewing machine through which needle thread extends to said first movable needle thread eyelets.

10 Claims, 2 Drawing Sheets

THREAD HANDLING SYSTEM FOR A SEWING MACHINE

BACKGROUND OF THE INVENTION

This invention relates to a new thread control mechanism for a sewing machine. The prior art thread control mechanisms, do not always apply an even tension to the needle threads and as a result uniform needle thread loops are not always produced on the underside of the work and the finished product often does not have uniform stitches. Also, portions of the thread control mechanism, that must be adjusted for the particular type of thread being used, are not conveniently accessible. The prior art thread control mechanisms are difficult and time consuming to rethread in the event of thread breakage or to change from one type of thread to another for example from cotton to polyester thread. Improperly adjusted thread control mechanisms result in thread breakage, non-uniform stitches and non-uniform needle loops. Considerable time, and thus cost, is required even by skilled sewing machine operators to obtain proper adjustment of the thread control mechanism and to rethread the machine or to change threads.

U.S. Pat. No 3,368,508 discloses a needle thread take-up device for a cover stitch sewing machine. The invention disclosed in this patent includes an adjustable eyelet member that is fixed to the sewing machine housing and a take up finger that is connected to the needle bar's oscillating lever and extends through a slot formed in the sewing machine housing. The needle thread extends through the fixed eyelet member and then through the eyelet member of the take up finger. Although the arcuate path followed by the take up finger is generally vertical, since it moves along an arc, its movement includes horizontal components and its vertical component is less than the vertical component of the needle bar. The take up device of this patent also includes a U-shaped thread guide, carried by the top of the needle bar, having aligned thread eyelets formed in the parallel legs of the U-shaped thread guide. The U-shaped thread guide includes an adjustable spring arm projecting between the legs of the U-shaped member that is biased into engagement with the needle thread. The U-shaped thread guide and adjustable spring arm cooperate with a take up that is fixed to the sewing machine frame and this combination functions to regulate the size of the needle thread loop. The invention of this patent resides in the cooperative arrangement of the fixed take up with the movable U-shaped thread guide and the adjustable spring arm. The precise adjustment of the various components of this complex needle thread take-up device is critical to proper operation and it is difficult and time consuming to change threads. Furthermore, the vertical component of movement of the take up finger is less than the vertical component of movement of the U-shaped thread guide, and as a result the movement of the U-shaped thread guide and the take up finger are not synchronized. This non-synchronized movement creates tension in the thread that extends between these components, which results in non uniform needle thread loops, non uniform stitches and thread breakage.

SUMMARY OF THE INVENTION

The present invention is directed to a new thread control mechanism that satisfies the needs of the prior art. This new thread control mechanism includes a second set of thread eyelets, on the exterior of the sewing machine frame, secured to the top of the needle bar. This second set of thread eyelets is as simple and easy to use as an eyelet can be, it requires only that each needle thread be threaded through an eyelet and require no complicated or time consuming adjustment. The new thread control mechanism also includes a first set of needle thread eyelets that is mechanically connected to the rotating upper mainshaft of the sewing machine which imparts vertical movement to the first set of needle thread eyelets that is synchronized with the movement of the second set of thread eyelets. The first set of needle thread eyelets are conveniently located on the exterior of the sewing machine frame between the needle bar and the thread tension devices, where it can be easily accessed for changing threads.

The new thread control mechanism provides the advantage over the prior art of less thread breakage, uniform needle thread loops, ease of changing threads, more uniform thread tension, more uniform stitches and cost savings attributable to the other advantages.

According to the invention the new thread control mechanism consists of a vertically reciprocating needle bar having an upper end that projects through the housing of the sewing machine and a lower end that supports the needles, a second movable needle thread control secured to the upper end of the needle bar from which the thread extends to the needles, a first movable needle thread control eyelet member operatively connected to the needle bar and restricted to vertical motion that is synchronized with the second movable needle thread control, and a stationary needle thread eyelet member adjustably mounted on the exterior of the sewing machine through which needle thread extends to said first movable needle thread eyelet member.

DETAILED DESCRIPTION OF THE PREFERRED EMBODIMENT

Figure 1:
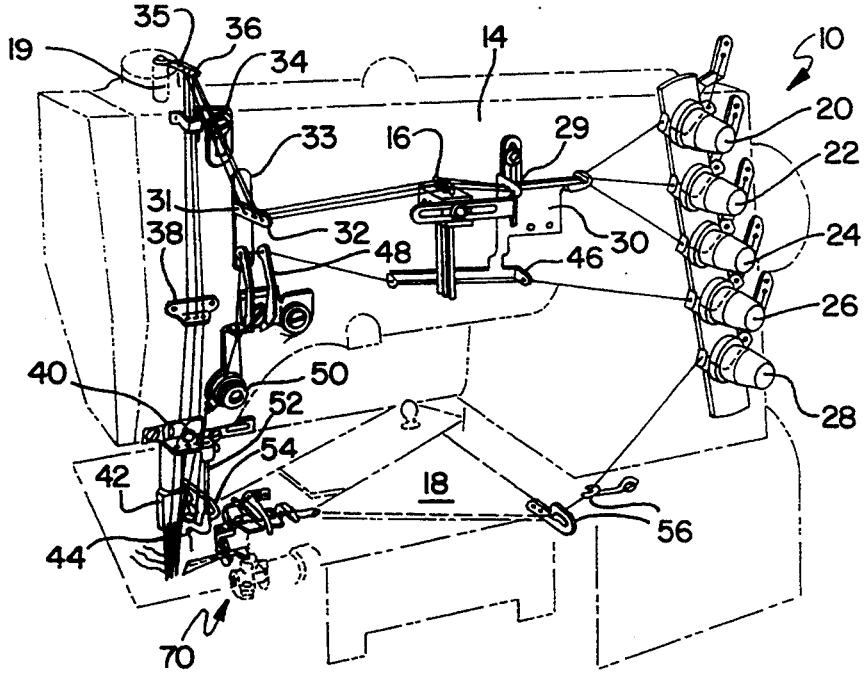
FIG. 1 is a perspective view of a sewing machine including the new thread control mechanism and stitch forming mechanism.
Figure 3:
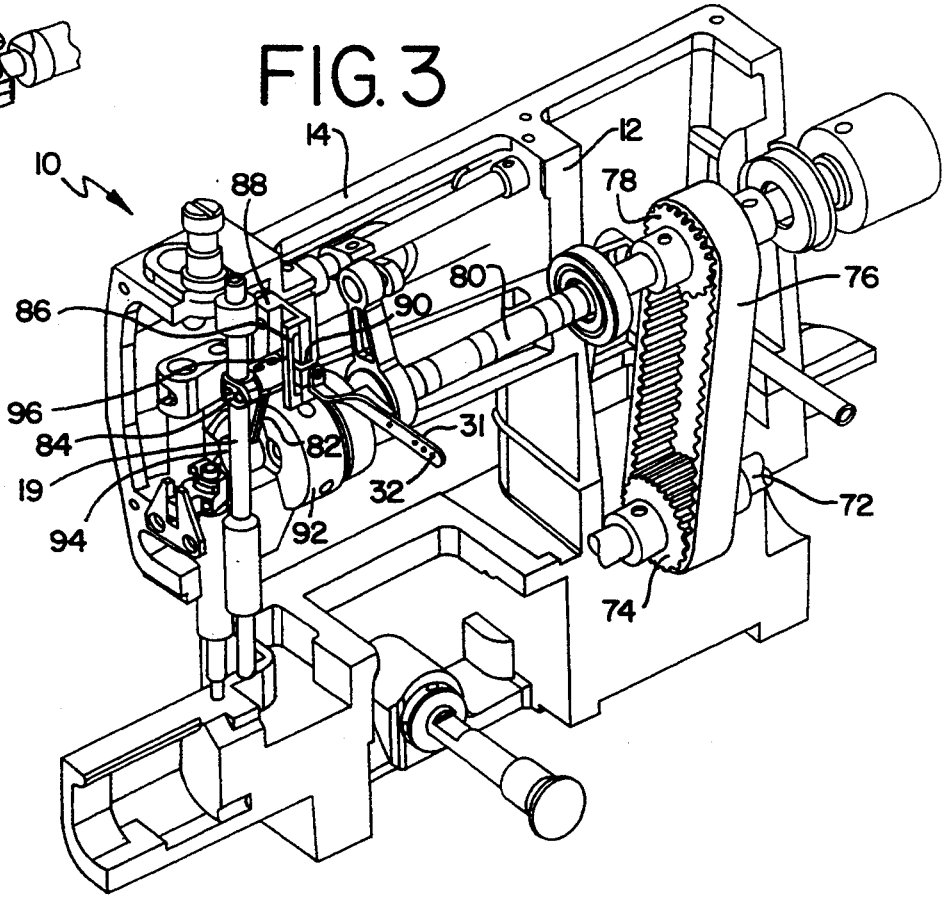
FIG. 3 is a perspective view of a sewing machine, with the exterior housing removed to show the drive mechanism for the upper stitch forming mechanisms.

FIG. 1 discloses a sewing machine 10 having an upper arm 14 and a base 18. The outer housing of sewing machine 10, is secured to the underlying sewing machine frame 12 which is shown in FIG. 3. As disclosed herein sewing machine 10 includes a vertical reciprocating needle bar 19 that carries a needle head 42 at its lower end. Three needles 44 are mounted in needle head 42. The sewing machine 10 includes a spreader thread guide 52 and spreader 54 for applying a cover thread to the upper surface of the stitch. A looper 70, mounted below the work surface of base 18, functions to interloop the looper thread with the needle threads.

Figure 2:
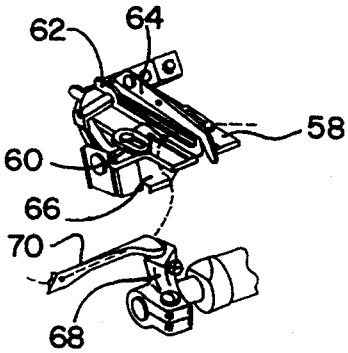
FIG. 2 is an enlarged perspective view of the looper mechanism, shown in FIG. 1, that cooperates with the needles on the bottom surface of the work to form the stitch.

The thread tension devices and other stitch forming mechanism for the three needle threads, spreader thread and looper thread are shown in FIGS. 1–3. The illustrated sewing machine 10 can be used to produce federal standard stitch types 401, 406, 407, 602 or 605. It should be noted that not all of these stitches utilize five threads and thus all of the thread handling mechanism are not always used. For example when forming a 407 stitch which does not include a cover thread the spreader mechanism is removed.

Although the sewing machine 10 is shown as a three needle machine, more or fewer needles could be used. Thus the term "set of eyelets" and its equivalent as used throughout the specification and claims of this patent should be understood to mean one or more eyelets.

On the right hand side of sewing machine 10 as seen in FIG. 1 there is a group of tension devices. Tension device 20 controls the tension on the left needle thread, tension device 22 controls the tension on the center needle thread, tension device 24 controls the tension on the right needle thread, tension device 26 controls the tension on the spreader thread and tension device 28 controls the tension on the looper thread. A needle thread frame 30 that includes an eyelet for each of the needle threads is adjustably fixed to the upper arm of the sewing machine. The needle threads from tensioning devices 20, 22 and 24 extend through this set of fixed needle thread eyelets 29 carried by the needle thread frame 30. The needle thread frame 30 also carries eyelets through which the thread from the spreader thread tension device 26 is threaded. The eyelets carried by the needle thread frame referred to as fixed eyelets 29 function to assist in supplying the appropriate amount of needle thread to the system. It should be noted that although eyelets 29 are fixed during sewing operation the position of needle thread frame 30 on the upper arm 14 can be adjusted within a range. When it is desired to increase the amount of needle thread included in each stitch needle thread frame 30 is adjusted to lower the set of eyelets 29 and when it is desired to decrease the amount of needle thread included in each stitch needle thread frame 30 is adjusted to raise the set of fixed eyelets 29.

A movable arm member 31 having the first set of needle thread control eyelets 32 formed therein extends through a vertical slot 33 formed in the sewing machine housing. The needle threads extend from the eyelets 29 through a set of individually adjustable eyelets 16 and then through eyelets 32 formed in movable arm member 31. Each of the eyelets 16 are formed in the upper end of a rod that is mounted to slide vertically and to be secured in a selected position. Adjustment of eyelets 16 may be necessary to effect a satisfactory take-up of the needle thread loops after cast-off from the looper or to stretch the thread so that upon relaxation of the thread during the up-stroke a satisfactory needle loop will be formed and skipping prevented. An arm member 35 secured to the upper most end of needle bar 19 extends horizontally and has the second set of needle thread eyelets 36 formed therein. The vertical reciprocal motion of the first and second movable needle thread eyelet or eyelets have upper and lower limits. The movable arm member 31 and the mechanism upon which it is carried is located relative to the upper end of the needle bar 19 such that the upper limit of the vertical movement of the first movable needle thread control eyelet or eyelets 32 is below the lower limit of the vertical movement of the second movable needle thread control eyelet or eyelets 36. The needle threads extend from the eyelets 32 formed in movable arm member 31 through the eyelets 36 formed in arm member 35. The needle threads extend from the eyelets 36 of arm member 35 through a needle thread strike-off 34, a needle thread frame eyelet 38, a needle thread nipper 40 and then through the eyelets of the needles 44.

As the needles 44 descend additional needle thread is pulled from the thread supply (not illustrated) through the thread tension devices 20, 22 and 24, fixed eyelets 29 and individually adjustable eyelets 16. Eyelets 29 and 16 are fixed and eyelets 32 and 36 both reciprocate in synchronized vertical paths. The vertical range of the reciprocating path of eyelets 32 is relatively close to being in horizontal alignment with eyelets 29, such that when needle thread is pulled through eyelets 32 and 29, it is being pulled in a generally horizontal direction. The eyelets 29 are formed by horizontal holes that are formed in a vertical member of needle thread frame 30. Thus this generally horizontal alignment of eyelets 29 and 32 permits the needle threads to be pulled through the horizontally orientated eyelets 29 in the horizontal direction which minimizes resistance between the needle threads and eyelets 29.

When the needles 44 ascend loops are formed from the needle threads adjacent the eyelets of needles 44 and the movable arm members 31 and 35 function to take up the slack in the needle thread. As best seen in FIG. 1 a triangle is formed by the points where the needle thread extends through eyelets 29, 32 and 36. The arms members 31 and 35, in which eyelets 32 and 36 are formed, are synchronized such that they both move at the same time along vertical paths that are identical in length. The eyelets 32 and 36 extend horizontally through arm members 31 and 35 and thus as the arm members 31 and 35 ascend the needle thread is lifted from two points. As a result of the synchronization of arm members 31 and 35 both arms lift the needle threads the precise same distance and thus minimizes tension in the needle thread and the need that the needle thread slide through the eyelets 32 and 36 during this take up step. Thus by synchronizing the movement of arm members 31 and 35 and horizontally aligning the eyelets 29 and 32 substantially all unnecessary tension has been eliminated in the needle threads during the stitch forming process.

The looper 70 which is a conventional design and can be seen in FIG. 1, is shown in a larger scale and; more details in FIG. 2. The looper 70 includes a cast-off support plate 58, a take-up eyelet 60, a castoff wire 62, a retaining finger 64, a take-up disc 66, a looper holder 68 and the looper 70.

The drive for the needle bar 19 and movable arm member 31 will now be described with reference to FIGS. 3, 4 and 5. In FIG. 3 a portion of the sewing machine frame has been eliminated to better illustrate the sewing machine drive mechanism. A lower main shaft 72 has a lower sprocket 74 secured thereto such that sprocket 74 rotates with shaft 72. An upper main shaft 80 is journaled above the lower main shaft 72 such that it extends horizontally through the upper arm 14 of the sewing machine 10. An upper sprocket 78 is secured to upper main shaft 80 and a timing or drive belt 76 overlies lower sprocket 74 and upper sprocket 78 so that rotation of the lower main shaft 72 is transmitted to the upper main shaft 80. A crank 92 is carried by the upper main shaft 80 at its free end.

Figure 4:
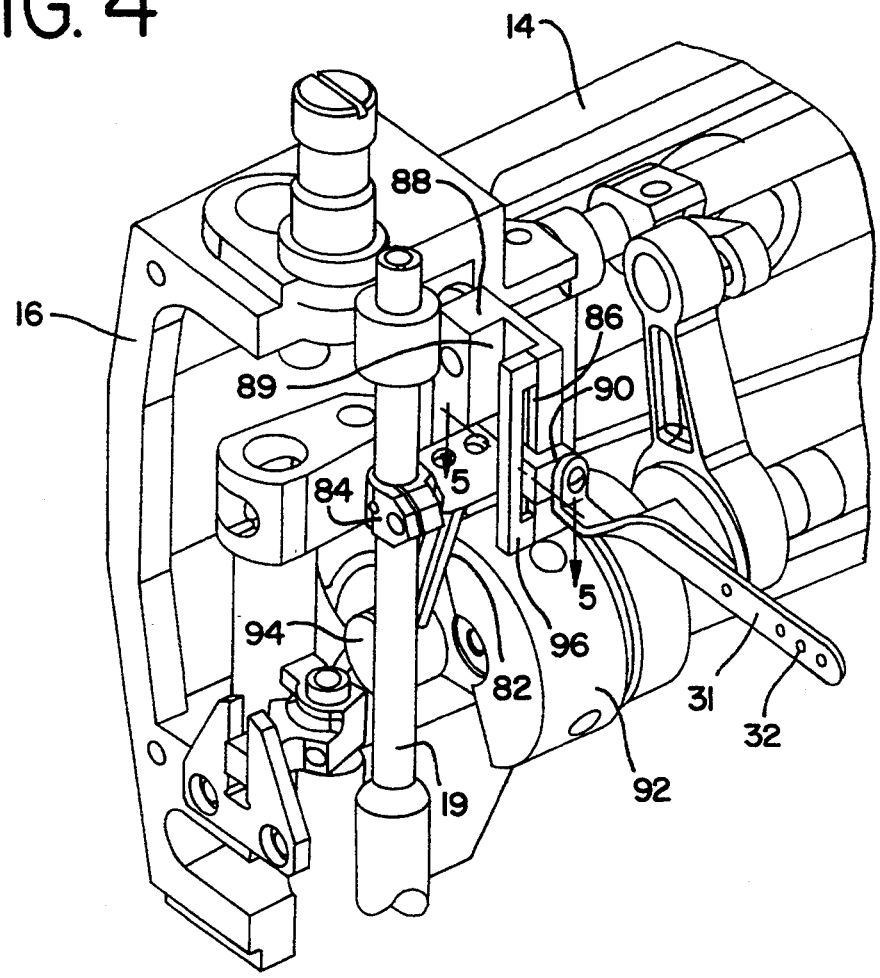
FIG. 4 is an enlarged perspective view of the slide block and slide block guide drive mechanism.
Figure 5:
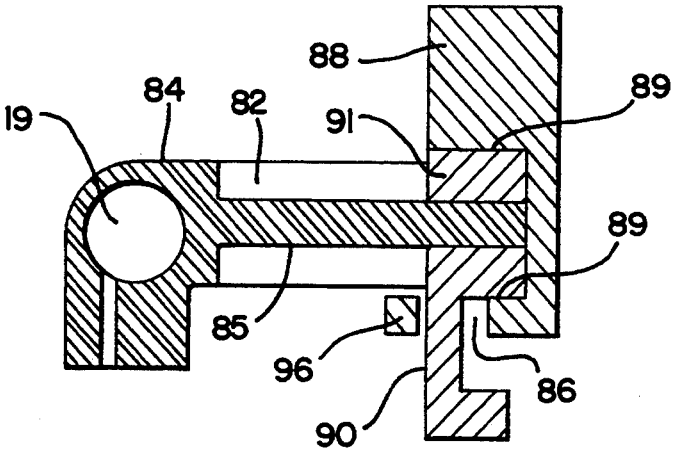
FIG. 5 is a cross sectional view taken along line 5—5 of FIG. 4.

The crank 92 and the elements that are driven thereby are shown in FIG. 3 and also in a larger scale in FIG. 4. The needle bar 19 is journaled for vertical reciprocation in the upper arm 14. A needle bar connection 84 is connected to a mid portion of the needle bar 19. A slide block guide 88 having parallel vertical slide surfaces 89 is secured within the upper arm 14 adjacent the needle bar connection 84. The slide block guide 88 includes a U-shaped retaining brace 96 which when connected to the slide block guide 88 forms a slot 86. A slide block 91 having vertical slide surfaces 89, that engage the vertical slide surface, also identified by reference number 89, of the slide block guide. The slide block 91, and includes an arm 90 that extends through the slot 86. The crank 92 includes a crank pin 94 upon which one end of a needle bar drive link 82 is journaled. The other end of needle bar drive link 82 is journaled on a cylindrical section 85 (see FIG. 5) of the needle bar connection 84. The cylindrical section 85 of the needle bar connection 84 is journaled in the slide block 91. When upper main shaft 80 rotates motion is transmitted through needle bar drive link 82 to the slide block 91 causing slide block 91 to reciprocate in the slide block guide 88. The cooperating vertical parallel slide surfaces 89 of the slide block guide and the slide block confines the motion of the slide block to vertical movement. The arm member 31 that is connected to arm 90 of the slide block 91 reciprocates vertically along with the slide block 91. Since the reciprocating vertical movement is transmitted by needle bar drive link 82, in synchrony, to both needle bar 19 and slide block 91, the reciprocating vertical movement of arm members 31 and 35 are also synchronized.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims.

It is claimed:

1. A sewing machine including a housing having an exterior and a thread handling system comprising:

a thread tension device secured to the exterior of said housing;

a stitch forming mechanism including a vertically reciprocating needle bar having an upper end, that projects through said housing to the exterior of the sewing machine housing, and a lower end upon which is mounted at least one needle;

a stationary needle thread eyelet member adjustably mounted on the exterior of the sewing machine housing and through which a thread from said thread tension device extends;

a first movable needle thread control eyelet member including means for operatively connecting it to said needle bar, a guide for confining said first movable needle thread control eyelet member to vertical reciprocal motion, said first movable needle thread control eyelet member extending through an opening in the housing to the exterior of the sewing machine; and a second movable needle thread control eyelet member secured to the upper end of said needle bar through which thread from said first movable needle thread control eyelet extends and from which the thread extends to said needle.

2. The invention as set forth in claim 1 in which the sewing machine includes an upper arm, a driven mainshaft mounted within said upper arm, a crank carried by said driven mainshaft, a needle bar drive connection secured to said needle bar, a needle bar drive link pivotally connected at one end to said crank and at its other end to said needle bar drive connection such that the rotary motion of said driven mainshaft causes said needle bar to reciprocate vertically.

3. The invention as set forth in claim 1 in which said guide includes:

a slide block guide mounted internally of said sewing machine housing adjacent said needle bar, said slide block guide having vertical guide surfaces; and a slide block having vertical guide surfaces adapted to engage the vertical guide surfaces of said slide block guide.

4. The invention as set forth in claim 3 wherein a needle bar drive connection is secured to said needle bar and said slide block is connected to said needle bar drive connection such that said slide block is caused to reciprocate vertically, and said first needle thread control eyelet member is connected to said slide block.

5. The invention as set forth in claim 1 wherein said reciprocating needle bar is horizontally separated from said thread tension device, said stationary needle thread eyelet member is mounted on the exterior of the sewing machine housing at a location between said thread tension device and said reciprocating needle bar, and said first movable needle thread control eyelet member extends through an opening formed in the housing that is located between said stationary needle thread eyelet member and said reciprocating needle bar.

6. The invention as set forth in claim 5 wherein the vertical reciprocal motion of said first and second movable needle thread control eyelet members have upper and lower limits, and the upper limit of the vertical movement of said first movable needle thread control eyelet is below the lower limit of the vertical movement of the second movable needle thread control eyelet.

7. The invention as set forth in claim 1 in which said thread handling system has multiple thread tension devices;

said reciprocating needle bar has multiple needles mounted thereon; and said stationary needle thread eyelet member, said first movable needle thread control eyelet member and said second movable needle thread control eyelet member all have multiple eyelets formed therein.

8. A method of handling the needle thread for a sewing machine of the type that includes a housing having an exterior, a first movable needle thread eyelet member operatively connected to the needle bar that extends through the housing to the exterior thereof, a reciprocating needle bar that has a needle with an eye and a second movable needle thread eyelet member that is secured to the upper end of the needle bar wherein the improvement comprises the steps of:

(a) applying a tension to the needle thread through a thread tension device mounted on the exterior of the sewing machine housing;

(b) passing the needle thread through a stationary needle thread eyelet that is mounted on the exterior of the sewing machine housing;

(c) passing the needle thread through the first movable needle thread eyelet member that extends through an opening in the housing such that it is located on the exterior of the sewing machine housing (d) providing a guide (e) confining the first movable needle thread eyelet member to vertical reciprocal motion with the guide;

(f) passing the needle thread through a second movable needle thread eyelet member that is secured to the upper end of the needle bar which is always on the exterior of the sewing machine housing; and (g) threading the needle thread through the eye of the needle.

9. The invention as set forth in claim 8 wherein the step of confining the first movable needle thread eyelet member to vertical reciprocal motion further includes providing a vertical slide block and slide block guides that control its movement.

10. The invention as set forth in claim 8 in which as the needle thread progresses through steps (a) through (f) it is:

(h) advancing in a generally horizontal direction from the thread tension device to the second movable needle thread eyelet.

* * * * *